US008550021B2

(12) United States Patent
Kawaguchi et al.

(10) Patent No.: US 8,550,021 B2
(45) Date of Patent: Oct. 8, 2013

(54) CAP-FRAME SETTING FRAME

(75) Inventors: Yasuhiko Kawaguchi, Nagoya (JP); Takahira Osamura, Kitanagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 898 days.

(21) Appl. No.: 12/659,062

(22) Filed: Feb. 24, 2010

(65) Prior Publication Data

US 2010/0218709 A1 Sep. 2, 2010

(30) Foreign Application Priority Data

Mar. 2, 2009 (JP) ..... 2009-047921

(51) Int. Cl.
*D05C 7/04* (2006.01)

(52) U.S. Cl.
USPC ..... 112/103

(58) Field of Classification Search
USPC ..... 112/103, 104, 114, 475.11, 470.13, 112/470.14
See application file for complete search history.

(56) References Cited

U.S. PATENT DOCUMENTS

| | | | | |
|---|---|---|---|---|
| 6,463,867 | B2 * | 10/2002 | Kato | 112/103 |
| 7,080,602 | B2 * | 7/2006 | Kawaguchi et al. | 112/103 |
| 7,100,523 | B2 * | 9/2006 | Terao | 112/103 |
| 8,245,655 | B2 * | 8/2012 | Kawaguchi et al. | 112/103 |

FOREIGN PATENT DOCUMENTS

| | | |
|---|---|---|
| JP | A-8-232159 | 9/1996 |
| JP | A-9-78437 | 3/1997 |
| JP | A-11-21757 | 1/1999 |

* cited by examiner

*Primary Examiner* — Tejash Patel
(74) *Attorney, Agent, or Firm* — Oliff & Berridge, PLC

(57) ABSTRACT

A cap-frame setting frame to which a cap frame holding a cap with a part on which embroidery is sewn by an embroidery sewing machine is detachably attached. The cap-frame setting frame includes a base frame having a distal end and a proximal end and including a fixing mechanism which is located at the proximal end side and is to be fixed to a predetermined work table, a rotating frame located at the distal end side of the base frame and having a cylindrical mount portion to which the cap frame is mounted so as to be positioned, a disc-shaped support secured to the base frame and configured to rotatably support the rotating frame, and a fitting portion located on the base frame to be fitted with an outer periphery of the disc-shaped support, thereby being rotatably supported on the base frame.

18 Claims, 11 Drawing Sheets

CAP-FRAME SETTING FRAME

CROSS-REFERENCE TO RELATED APPLICATIONS

This application is based on and claims the benefit of priority from the prior Japanese Patent Application No. 2009-47921, filed on Mar. 2, 2009, the entire contents of which are incorporated herein by reference.

BACKGROUND

1. Field

The present disclosure relates to a cap-frame setting frame to which a cap frame holding a cap with a part on which embroidery is to be sewn by an embroidery sewing machine is detachably. attached.

2. Related Art

There have conventionally been provided embroidery sewing machines which can embroider a front, right and left sides and/or a rear of a cap such as a baseball cap. In one of these embroidery sewing machines, a cap is set on a cap frame, and the cap frame is detachably coupled to a moving mechanism, whereby embroidery can be sewn on the cap. When attaching or detaching the cap to or from the cap frame, an operator attaches the cap frame to a cap-frame setting frame and then attaches or detaches the cap to or from the cap frame.

The conventional cap-frame setting frame includes a fixing mechanism which fixedly mounts the cap-frame setting mechanism onto a work table, and a cylindrical cap-frame support frame provided in front of the fixing mechanism. The cap frame includes a cylindrical body which is mounted on the cap-frame support frame so that the body of the cap frame is fitted with the support frame from the outside, while the body of the cap frame is positioned with respect to a rotational direction (circumferential direction). The cap is fixedly set on the cap frame while the front with a visor is directed upward. However, since the cap-frame support frame is fixedly mounted in the conventional cap-frame setting frame, for example, the rear of the cap is hard to secure to the cap frame with clips. This poses a problem.

In view of the problem, it has recently been proposed that the cap-frame setting frame should comprise two components, that is, a base frame which is fixed via the fixing mechanism on the work table and a rotating frame on which the cap frame is mounted. In this case, the rotating frame is rotatably supported on the base frame. As a result, the operator can set the cap while the cap frame (the cap) attached to the rotating frame is being rotated, whereupon the working efficiency can be improved.

More specifically, a first conventional example includes a support shaft provided on the center of a disc-shaped base frame. The rotating frame is rotatably supported on the support shaft. Furthermore, a second conventional example providing a different construction including a rotating frame having a disc-shaped underside (a proximal end face) formed with a slit extending into an arc shape about a rotational center of the rotating frame, instead of the aforementioned support shaft. Furthermore, a pair of pins are fixedly mounted on the base frame side. The pins are inserted into the slit and slid relative to each other, whereby the rotating frame is rotatably supported.

In the first conventional example, however, the support shaft and its vicinity are subjected to a large load such that the support shaft would be worn out by load concentration. Thus, the first conventional example has a low durability.

In the second conventional example, the paired pins are deviated to one side (upper side) from the rotational center. As a result, the rotating frame cannot be rotated smoothly. Additionally, the rotating frame of the conventional cap-frame setting frame is provided with no grips the operator holds with his/her hands. Thus, the rotating frame is hard to rotate.

SUMMARY

Therefore, an object of the present disclosure is to provide a cap-frame setting frame in which the rotating frame is rotatably supported on the base frame and which can prevent concentration of load on the support and its vicinity and can provide smooth rotation of the rotating frame.

The present disclosure provides a cap-frame setting frame to which a cap frame holding a cap with a part on which embroidery is to be sewn by an embroidery sewing machine is detachably attached, the cap-frame setting frame comprising a base frame having a distal end and a proximal end and including a fixing mechanism which is located at the proximal end side and is to be fixed to a predetermined work table, a rotating frame provided at the distal end side of the base frame and having a cylindrical mount portion to which the cap frame is mounted so as to be positioned, a disc-shaped support secured to the base frame and configured to rotatably support the rotating frame, and a fitting portion provided on the base frame to be fitted with an outer periphery of the disc-shaped support, thereby being rotatably supported on the base frame.

DETAILED DESCRIPTION

One embodiment will be described with reference to the accompanying drawings. For example, a multineedle embroidery sewing machine performs an embroidery sewing on a part of a cap C (shown by imaginary line in FIG. 8 etc.) to be sewn, such as a front, right or left side or a rear thereof. The cap C is a baseball cap, for example. In execution of the embroidery sewing, a cap frame 1 as shown in FIGS. 8 to 11 is used to support the cap C in the embodiment. When an operator attaches or detaches the cap C to or from the cap frame 1, the cap frame 1 is detachably attached to a cap-frame setting frame 11.

Figure 8:
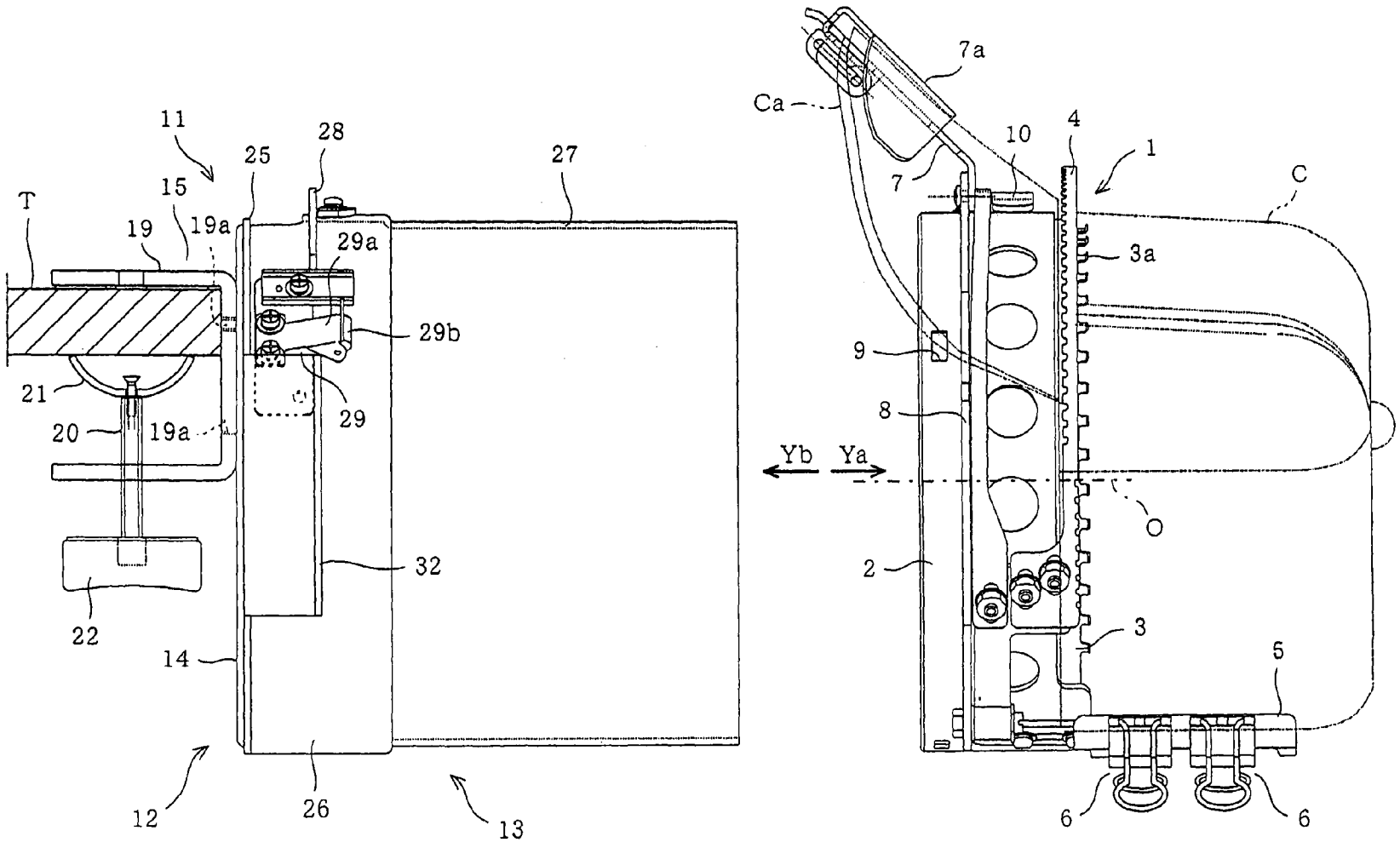
FIG. 8 is a left side view of the embroidery-frame setting frame and a cap frame, showing the state before attachment of the cap frame to the embroidery-frame setting frame.
Figure 9:
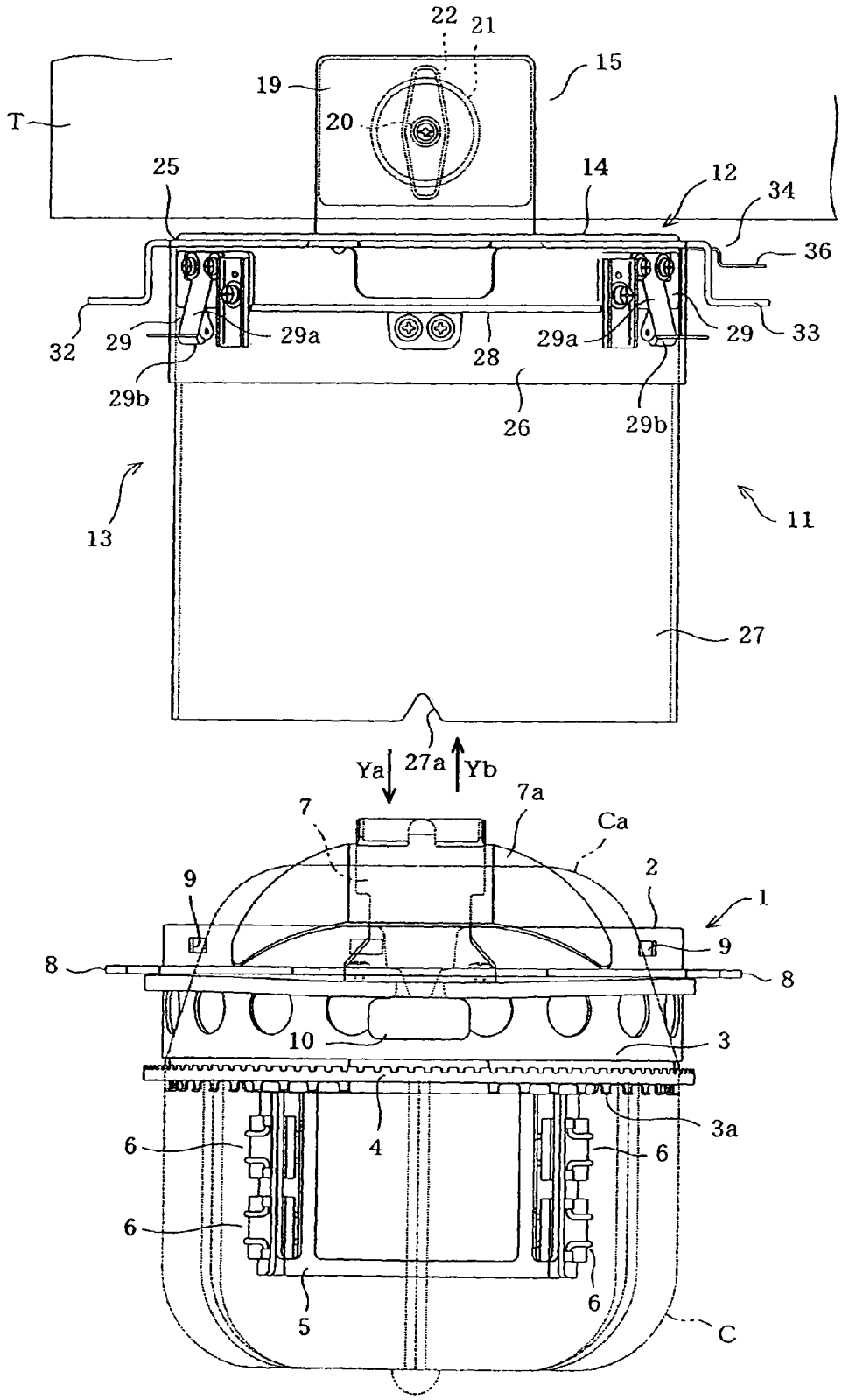
FIG. 9 is a plan view of the embroidery-frame setting frame and a cap frame, showing the state before attachment of the cap frame to the embroidery-frame setting frame.
Figure 10:
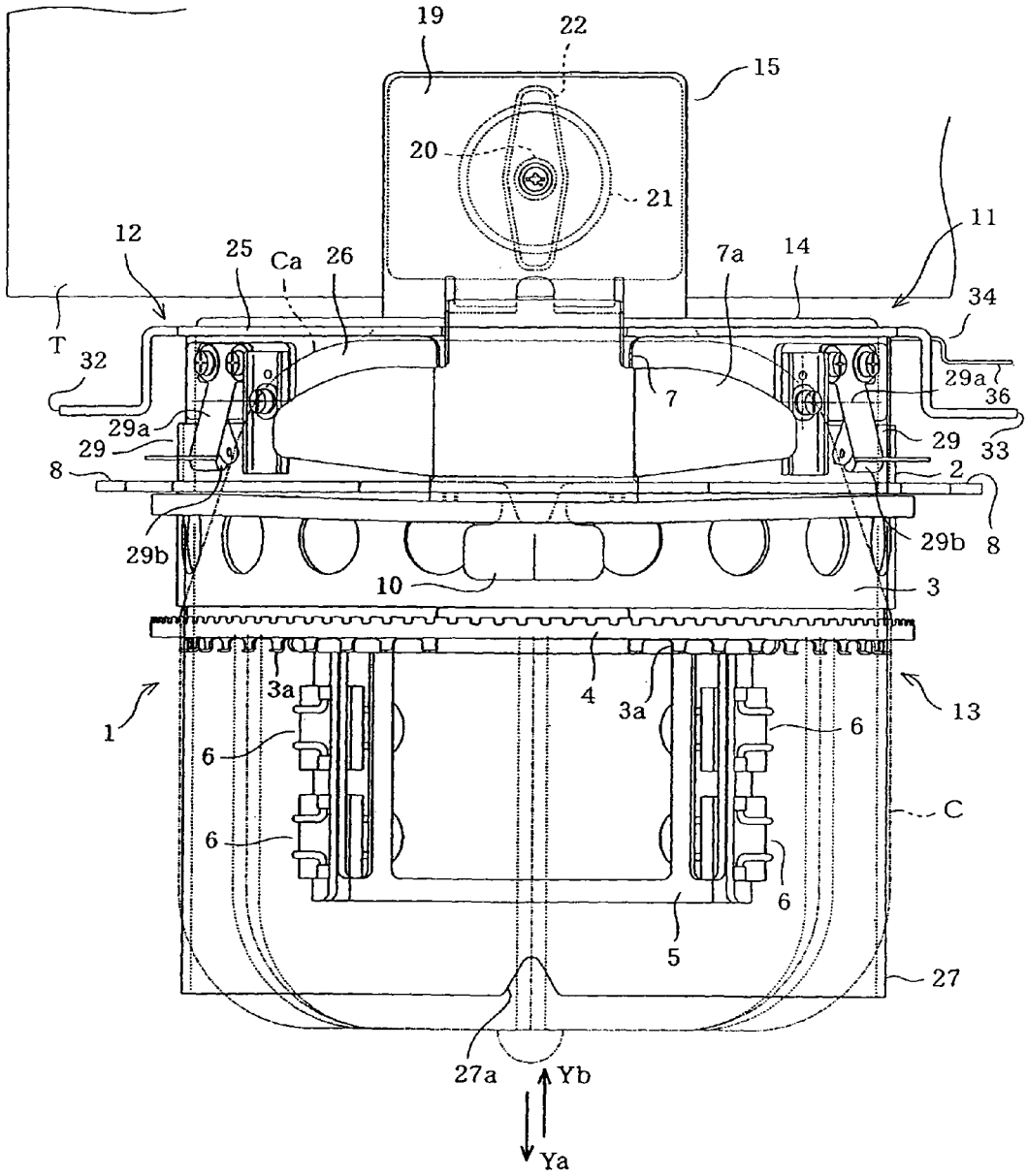
FIG. 10 is a plan view of the embroidery-frame setting frame and a cap frame, showing the state after attachment of the cap frame to the embroidery-frame setting frame.

In the following description, the side where the operator is located to attach or detach the cap frame 1 to or from the cap-frame setting frame 11 will be referred to as "front" and the side opposite the front will be referred to as "rear." As shown in FIGS. 8 to 10, the arrow Ya in FIGS. 1A and 1B in which the cap frame 1 is detached from the cap-frame setting frame 11 denotes the frontward direction. The arrow Ya in FIGS. 1A and 1B in which the cap frame 1 is attached to the cap-frame setting frame 11 denotes the rearward direction.

The multineedle embroidery sewing machine will first be described in brief although not shown. The multineedle embroidery sewing machine includes a base, an arm extending frontward above the base, and a needle bar case which is mounted on a distal end of the arm and houses a plurality of needle bars. The needle bars have lower ends to which a plurality of needles are attached respectively. A plurality of embroidery threads with different colors are set to the needles respectively. In the arm is provided a selective needle bar driving mechanism which selects one of the needle bars in the needle bar case and moves the selected needle bar upward and downward. The base is provided with a cylinder bed which has a thread loop taker and the like and extends frontward.

The base is also provided with a transferring mechanism which includes a carriage to which a known embroidery frame or the cap frame 1 is coupled. The embroidery frame holds a workpiece cloth in a horizontal state, and the cap frame 1 holds the cap C. The transferring mechanism is constructed so as to move the embroidery frame in the front-rear direction (the Y direction) and in the right-left direction (the X direction) perpendicular to the front-rear direction. When coupled to the carriage, the cap frame 1 is moved in the front-rear direction (the Y direction) and rotated about a central axis O of a cap frame body 2 as shown in FIGS. 8 and 11.

The cap frame 1 will now be described with reference to FIGS. 8 to 11. The cap frame 1 holding the cap C is of a non-frame type, and the cap C is attached to the cap frame 1 from the front of the cap frame with a front visor Ca being directed upward. The cap frame 1 has the annular or thin cylindrical cap frame body 2 which is to be fitted with an outer circumference of the rotating frame 13 of the cap-frame setting frame 11 which will be described later. Furthermore, the cap frame 1 includes a cap support 3 receiving an inner face of the opening side end of the cap C, a pressing member 4 pressing the outer side of the cap C, a receiving frame 5 for fixing the cap C, four clips 6 for fastening the fabric of cap C to the receiving frame 5 thereby to fix the cap C, and a visor support 7 supporting the visor Ca of the cap C.

Figure 11:
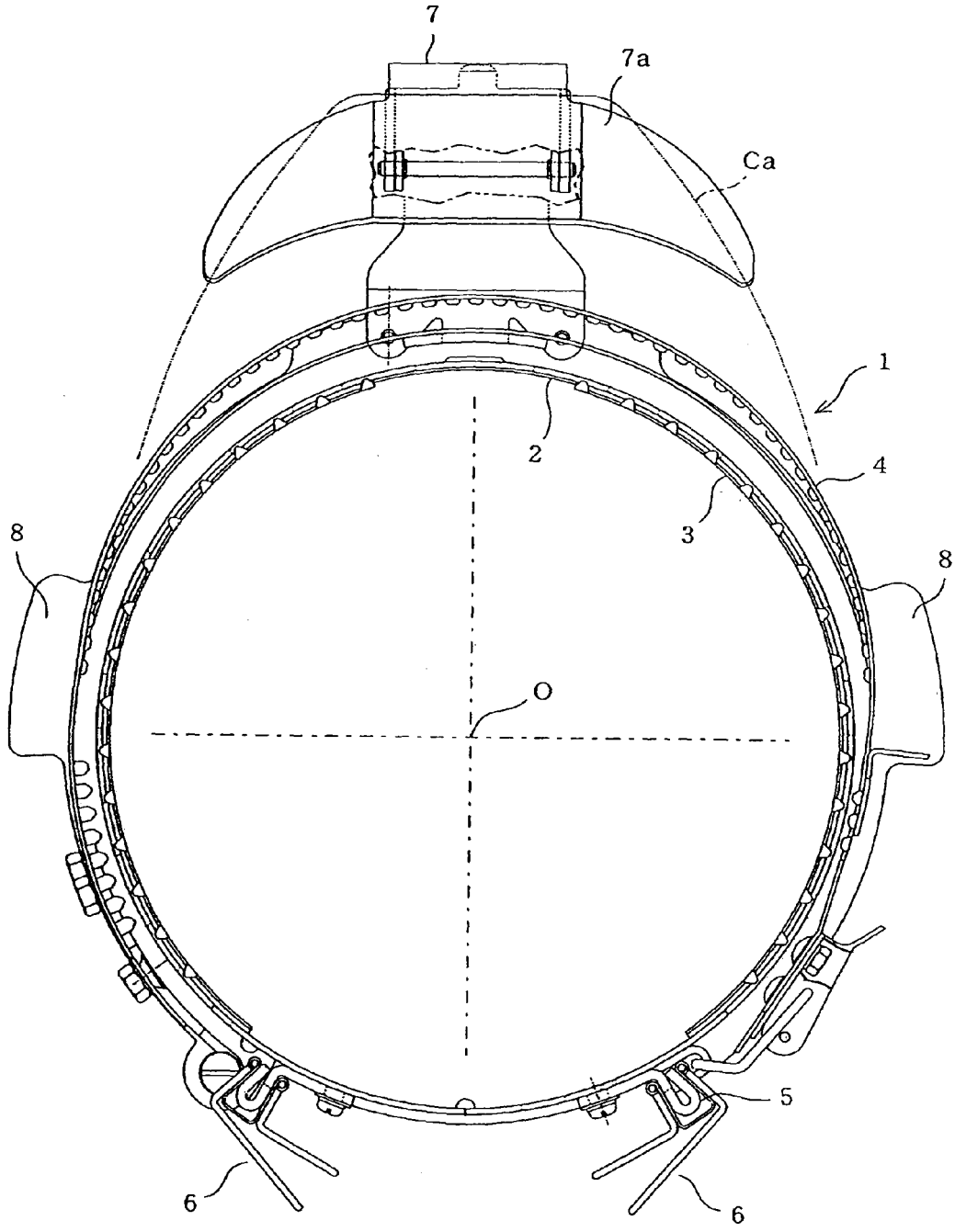
FIG. 11 is a front view of the cap frame.

A pair of knobs 8 are formed integrally on the outer circumference of the cap frame body 2 so as to be located at portions slightly away from the middles of semicircular portions of the cap frame body 2, as shown in FIGS. 8 and 11. The knobs 8 extend sideways. The cap frame body 2 has a rear end formed with a pair of right and left engagement holes 9 as shown in FIGS. 8 and 9. Furthermore, the cap frame body 2 has an upper end provided with a holding member 10 which is located in front of the visor support 7. A sweat collecting portion (not shown) of the cap C folded to the inner circumferential side is held by the holding member 10 so as to be nipped in an open state. The aforesaid visor support 7 is provided to stand on a central upper end of the cap frame body 2 so as to be inclined rearwardly upward as shown in FIG. 8. The visor support 7 has an upper end provided with a visor fixing member 7*a* which nips the distal end of the visor Ca of the cap C thereby to fix the cap C.

The cap support 3 is formed integrally with the front end side of the cap frame body 2 and has a number of claws 3*a* aligned circumferentially. The pressing member 4 is formed into a semicircular arc frame shape with a small width and is mounted to the outer circumferential surface of the cap support 3 so as to be opened and closed (rotatable). The opening side of the cap C is put between the claws 3*a* of the cap support 3 and the pressing member 4 thereby to be held in position. The receiving frame 5 extends frontward from near a lower part of the cap frame body 2. The cap C is held by clipping the same by the clips 6 from outside the workpiece cloth on the right and left sides of the receiving frame 5 while the fabric of the cap C is stretched tight inside the receiving frame 5. The receiving frame 5 may comprise two right and left receiving bars.

When the cap C is to be set on the aforesaid cap frame 1, the cap-frame setting frame 11 which will be described later is fixed to a predetermined work table T (see FIGS. 8 to 11). The cap frame 1 is attached to a predetermined position relative to the cap-frame setting frame 11. In this case, the pressing member 4 and the flange fixing member 7*a* remain open. In this state, the operator puts the cap C on the cap support 3 of the cap frame 1. Then, the pressing member 4 and the flange fixing member 7*a* are closed while the cap C is positioned, whereupon the cap C is fixed. With this, the receiving frame 5 (the receiving bar) is nipped by the clips 6 from outside the fabric of the cap C' while the fabric is being stretched tight. Thus, the setting of the cap C is completed.

The cap-frame setting frame 11 will now be described with reference to FIGS. 1A to 7. The cap-frame setting frame 11 roughly includes a base frame 12 fixed to the work table T and a rotating frame 13 which is rotatably supported at the distal end side of the base frame 12. As a result, the cap frame 1 is mounted to the rotating frame 13.

Figure 2B:
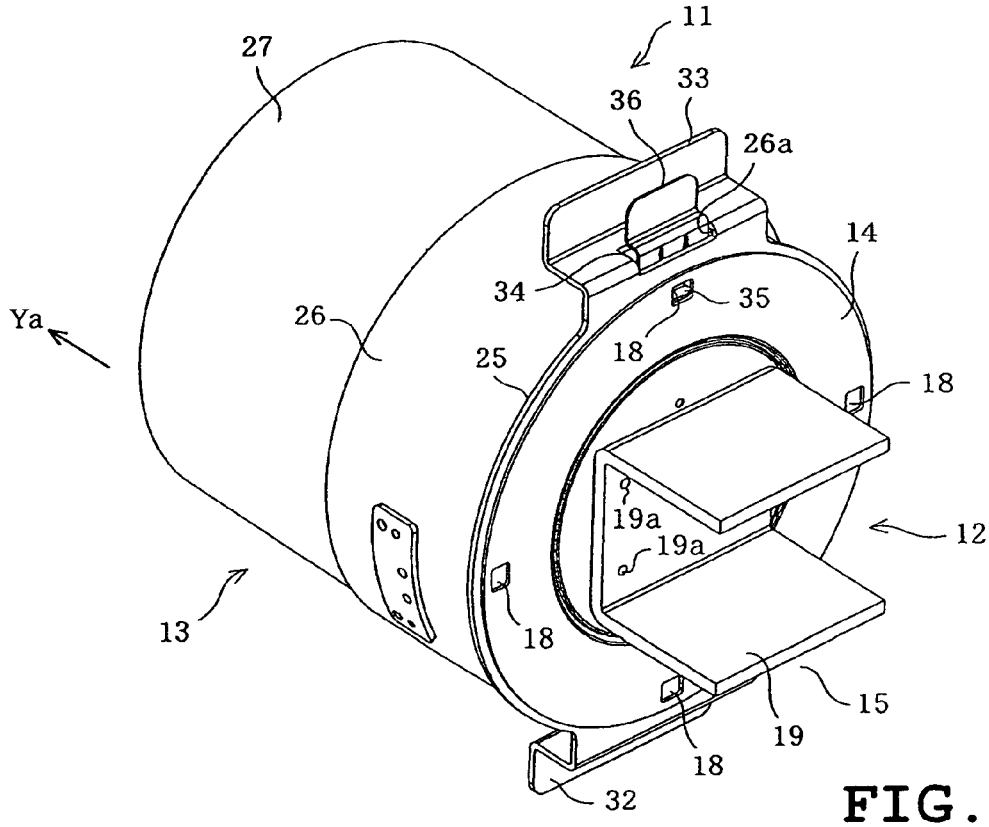
Figure 3:
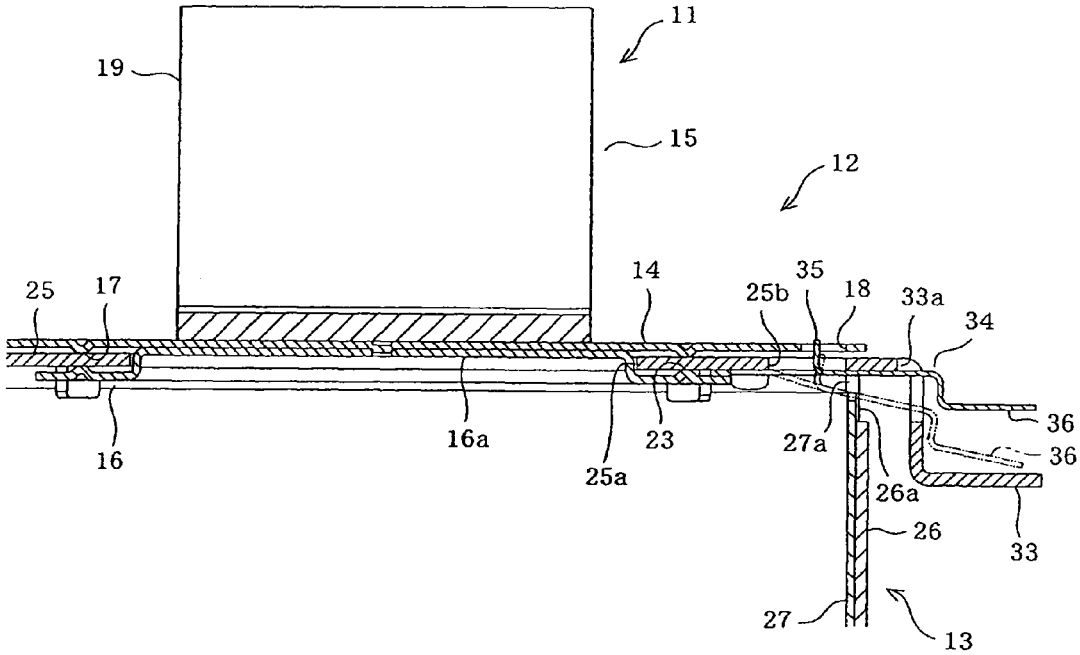
FIG. 3 is a partial transverse sectional view of the embroidery-frame setting frame.
Figure 5:
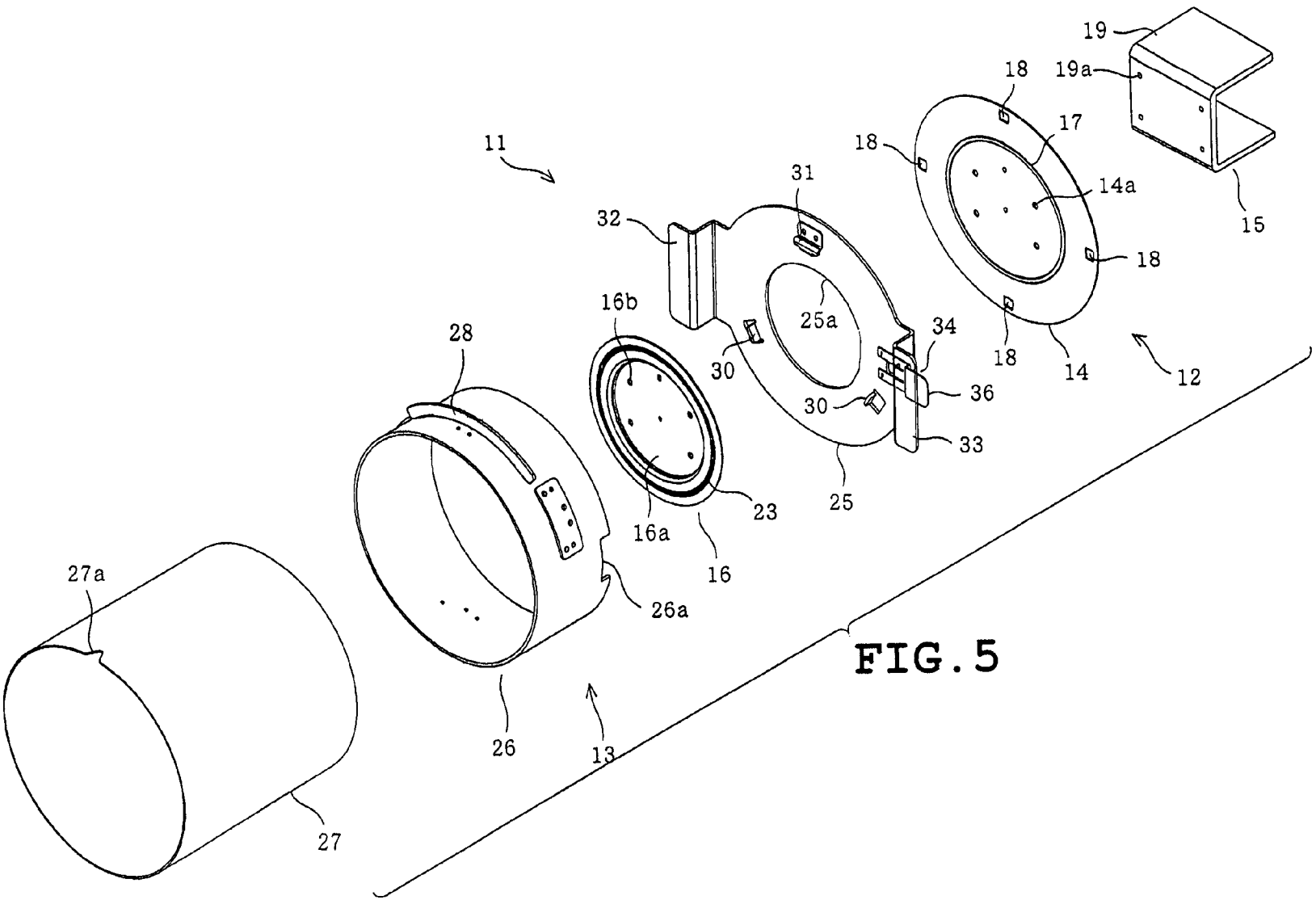
FIG. 5 is an exploded perspective view of the embroidery-frame setting frame.
Figure 6:
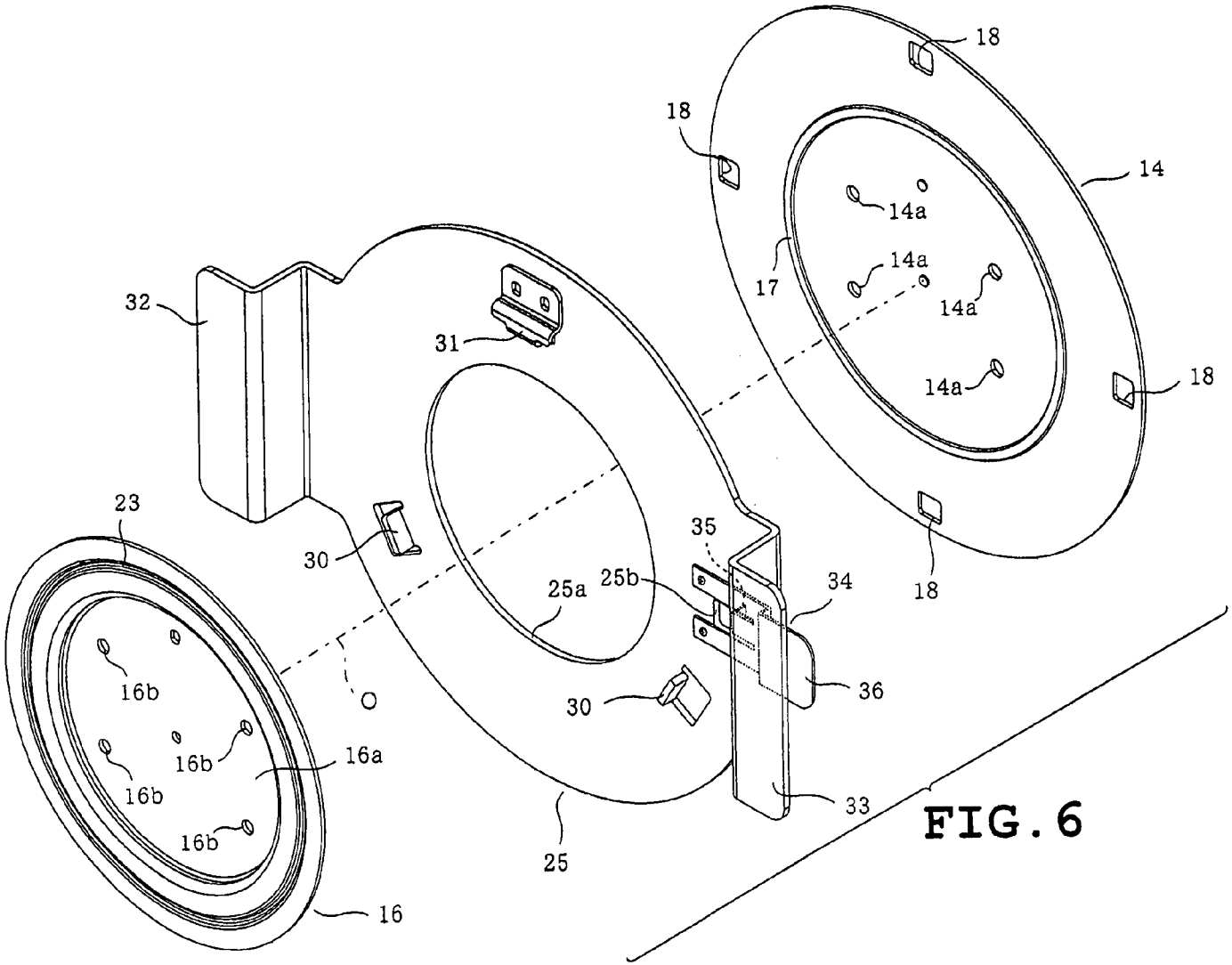
FIG. 6 is an enlarged exploded perspective view showing the fitting structure of a base plate, a disc-shaped support member and a rotating disc.
Figure 7:
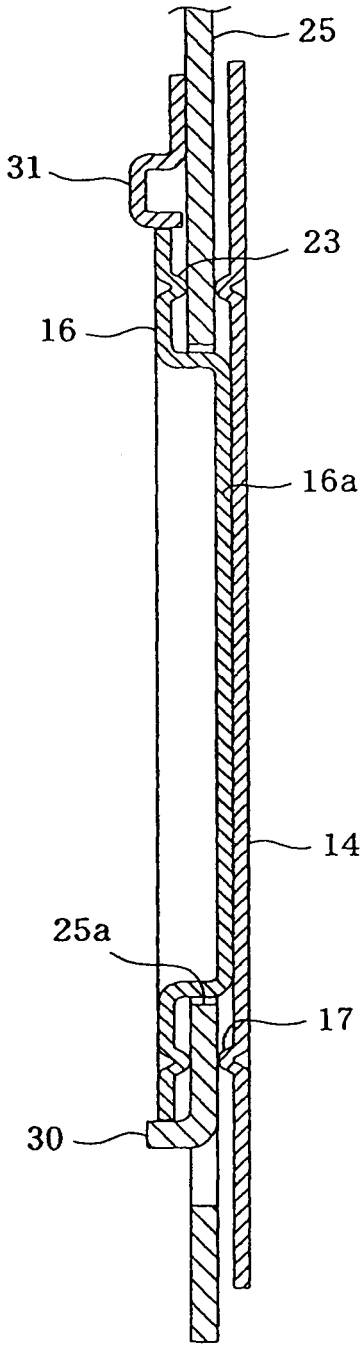
FIG. 7 is an enlarged longitudinal side section showing the fitting structure of the base plate, disc-shaped support member and rotating disc.

The base frame 12 includes a base plate 14, a fixing mechanism 15 provided at the rear side (proximal end side) of the base plate 14, and a disc-like support member 16 provided at the front side (distal end side) of the base plate 14, as shown in FIGS. 3, 5 and the like. The base plate 14, the fixing mechanism 15 and the support member 16 are screwed thereby to be coupled together. The base plate 14 is generally formed into a disc shape as shown in FIGS. 1B and 2B. The base plate 14 has a concentric annular projection strip 17 which is formed near the outer circumference of the base plate 14 by drawing so as to be convex at the front side, as shown in FIGS. 6, 7 and the like. Four lock holes 18 serving as locked portions are formed in the outer circumferential end of the base plate 14 at intervals of 90 degrees. The base plate 14 has a central area located inside the annular projection strip 17 as shown in FIG. 6. The central area of the base plate 14 is formed with four through screw holes 14*a*.

The fixing mechanism 15 includes a mounting member 19 which is mounted on the base plate 14 as shown in FIGS. 8 to 10 etc. The mounting member 19 includes a front plate, an upper plate and a lower plate and is formed into a general C-shape. A fastening screw 20 is threadingly engaged with a screw hole formed in the lower plate of the mounting member 19. The fastening screw 20 has an upper end provided with a pressing portion 21 which nips the work table T in cooperation with the upper plate of the mounting member. The fastening screw 20 also has a lower end provided with a knob 22.

When the work table T is inserted between the upper plate and the pressing member of the mounting member 19 and the knob 22 is turned to fasten the fastening screw 20, the base frame 12 is fixed to the work table T. The front plate of the mounting member 19 is formed with four screw holes 19*a* as shown in FIGS. 5, 8 etc. The fastening screw 20 and the like are not shown in FIGS. 1A to 5 for the sake of simplicity.

The aforementioned disc-like support member 16 has a slightly smaller diameter than the base plate 14 as shown in FIGS. 3 to 7. The support member 16 has a concentric annular projection strip 23 which is formed near the outer circumference thereof by drawing so as to be convex at the rear side and so as to correspond to the annular projection strip 17, as shown in FIGS. 6, 7 and the like. The support member 16 also has a circular convex portion 16*a* which is formed inside the projection strip 23 by drawing and which is convex to the rear side, as shown in FIG. 6 etc. The circular convex portion 16*a* has four screw holes 16*b*.

The support member 16 is disposed so as to nip a rotating disc 25 of the rotating frame 13 from both front and rear sides in cooperation with the base plate 14 as shown in FIGS. 5 to 7 etc. The rotating disc 25 will be described later. In this case, the fitting hole serving as the fitting portion provided in the rotating disc 25 is fitted with the outer circumference of the circular convex portion 16*a*, and the front plate of the mounting member 19 of the fixing mechanism 15 is disposed at the rear side of the base plate 14. In this state, four screws 24 (see FIG. 4) are inserted through the screw holes 16*b* and 14*a* in turn, thereafter being threadingly engaged with the screw holes 19*a*, respectively. As a result, the base plate 14, the support member 16 and the mounting member 19 of the fixing mechanism 15 are connected (secured) to one another.

On the other hand, the rotating frame 13 includes the rotating disc 25 located at the rear end side (the proximal end side), a cylindrical mounting portion 26 which is secured by welding or the like along the front side outer circumferential edge of the rotating disc 25 and a cylindrical holding member 27 which is mounted on the front of the mounting portion 26, as shown in FIGS. 1A to 5 etc. The outer circumference of the mounting portion 26 is closely fitted with the inner circumference of the cap frame body 2 of the cap frame 1. As a result, the cap frame 1 is mounted while being positioned in the front-rear direction and in the rotational direction.

In this case, the mounting portion 26 is provided with an arc flange 28 receiving a rear end of the cap frame body 2 of the cap frame 1 as shown in FIGS. 1A, 1B, 5, 8, 9 etc. With this, the mounting portion 26 is also provided with two engaging members 29 located on right and left of the flange 28 respectively. The engaging members 29 correspond to the right and left engagement holes 9 and include engagement rollers 29*b* which are rotatably mounted on the distal ends of the leaf springs 29*a* so as to engage the engagement holes 9 respectively. Each leaf spring 29*a* has a proximal end secured to the cylindrical mounting portion 26, so that each engagement roller 29*b* is normally urged by the leaf spring 29*a* in the engaging direction. When the engagement rollers 29*b* are engaged with the engagement holes 9 respectively, the cap frame 1 is held in the positioned state with respect to the front-rear direction and the circumferential direction. The engagement members 29 are not shown in FIGS. 1A to 5 for the sake of simplification.

The cylindrical holding member 27 receives (holds) the inside of the fabric of the cap C when the cap frame 1 is attached to the cap-frame setting frame 11. The cylindrical holding member 27 is mounted so as to fit with the inner circumferential side of the cylindrical mounting portion 26 as shown in FIG. 3. In this case, the cylindrical holding member 27 is slidable in the front-rear direction relative to the cylindrical mounting portion 26 although the sliding structure is not shown. As a result, the length of the cylindrical holding member 27 in the front-rear direction (the dimension of protrusion of the mounting portion 26) can be adjusted according to the height (depth) of the cap C. The cylindrical holding member 27 has a generally V-shaped positioning cutout 27*a* positionally corresponding to the front center of the cap C as shown in FIGS. 1A, 1B, 5, 10 etc. The operator then carries out alignment of the cap frame 1 while touching the cutout 27*a* with his/her fingers from over the fabric of the cap C.

Figure 4:
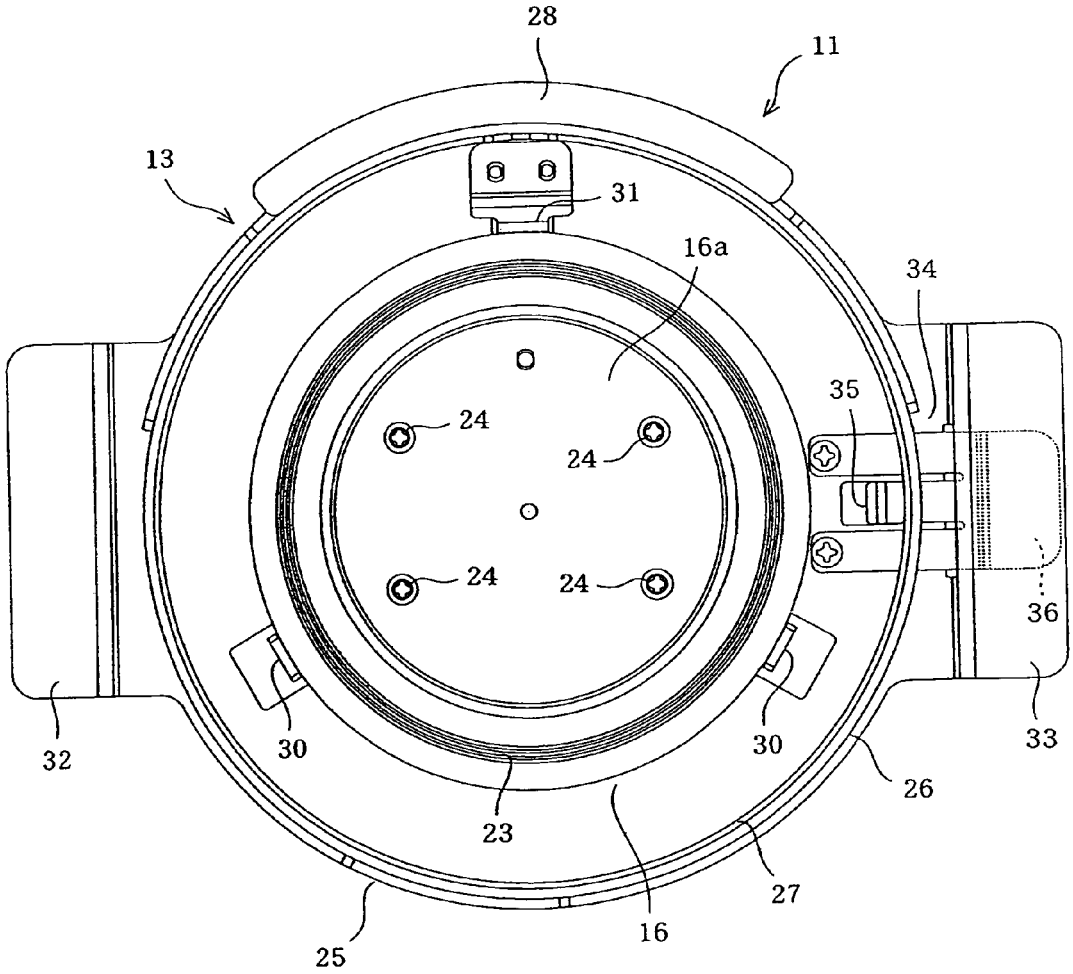
FIG. 4 is a front view of the embroidery-frame setting frame.

The aforementioned rotating disc 25 is formed into a general ring shape and has a centrally located fitting hole 25*a* serving as the fitting portion as shown in FIGS. 5 to 7. The front side of the rotating disc 25 has three protruding pieces 30 and 31 formed thereon at intervals of about 120 degrees so as to be located near the outer circumferential end thereof as shown in FIG. 4 as well as FIGS. 5-7. The protruding pieces 30 and 31 are disposed so as to receive the outer circumference of the support member 16 as shown in FIGS. 4 and 7. The two protruding pieces 30 disposed on the lower right and left portions are fixedly formed by cutting and raising the corresponding portions of the rotating disc 25, respectively. Furthermore, the upper protruding piece 31 is mounted so as to position the rotating disc in the vertical direction (in the diametrical direction).

The rotating disc 25 is thus disposed so as to be held between the disc-shaped support member 16 and the base plate 14 both constituting the base frame 12 from the front and the rear respectively as shown in FIGS. 3 and 7. In this case, the fitting hole 25*a* of the cap-frame setting frame 11 is slidably fitted with the outer circumference of the circular convex portion 16*a*, and the protruding pieces 30 and 31 slidably receive the outer circumference of the support member 16. Furthermore, the annular projection strip 23 of the support member 16 is brought into contact (sliding contact) with the front surface of the rotating disc 25, and the annular projection strip 17 of the base plate 14 is brought into contact (sliding contact) with the rear surface of the rotating disc 25. Consequently, the rotating disc 25 and accordingly the rotating frame 13 are supported on the base frame 12 so as to be rotatable about the central axis O.

Figure 1A:
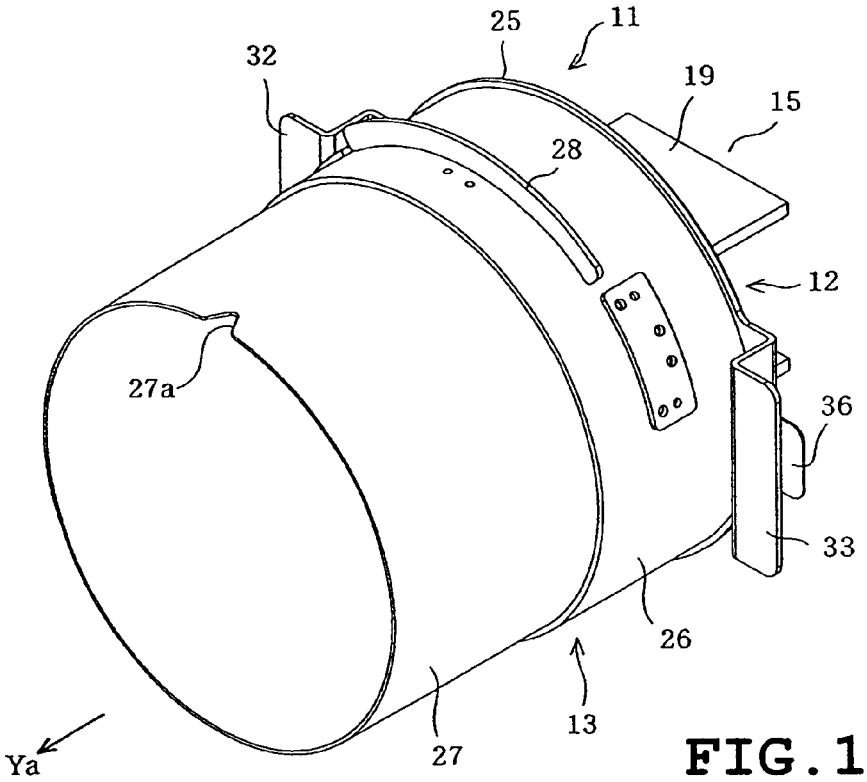
FIGS. 1A and 1B are perspective views of the embroidery-frame setting frame of one example as viewed from the front and the rear respectively.
Figure 1B:
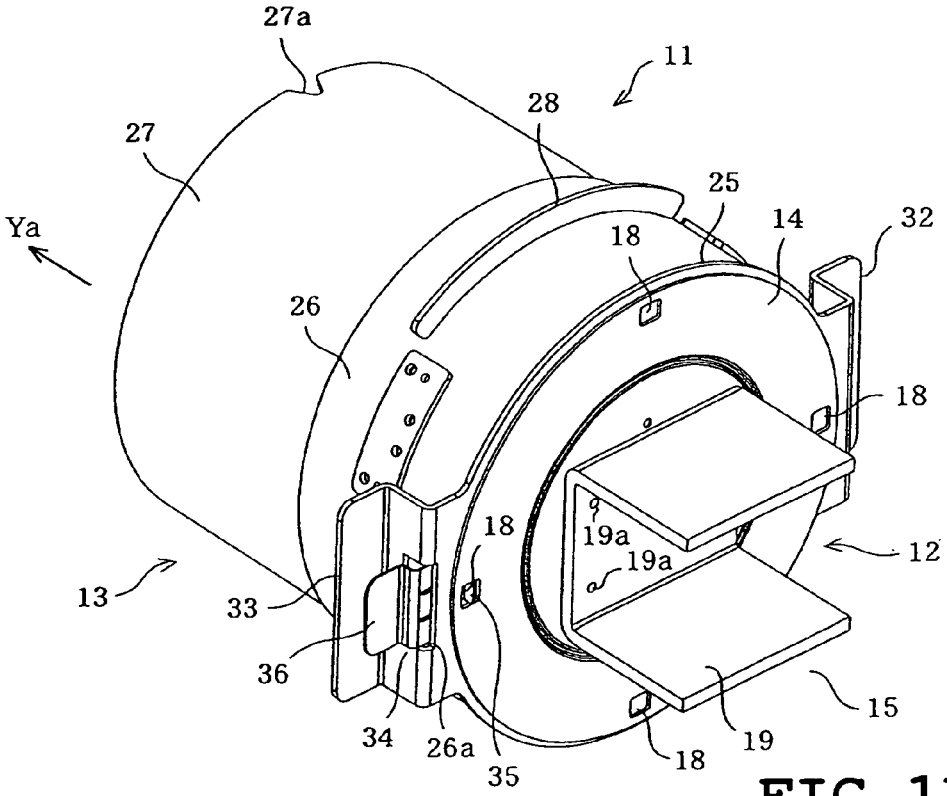

The rotating disc 25 has two grips 32 and 33 which are integrally formed therewith and located at right and left portions thereof and protruding outward or radially (in the right-left direction) in the state as shown in FIGS. 1A, 1B, 4 and the like. Each of the grips 32 and 33 extends in the right-left direction so as to be substantially coplanar with the disc surface of the rotating disc 25, thereafter being bent frontward, as shown in FIGS. 2A to 6 as well as in FIGS. 1A, 1B and 4. Furthermore, a distal end of each grip extends (is bent) in the right-left direction (circumferentially). The grips 32 and 33 are located opposite the knobs 8 respectively as shown in FIGS. 9 and 10.

The rotating disc 25 is further provided with an operating member 34 located on the right grips 33. The operating member 34 and the lock holes 18 formed in the base plate 4 constitute a locking mechanism which engages the rotating frame 13 with the base frame 12 selectively at one of a plurality of positions and locking the rotating frame 13 in position. In the embodiment, the operating member 34 comprises a metal material (a leaf spring) having springiness or elasticity and includes a locking member engageable with one of the lock holes 18 and a release operating member which is operated by the operator to release the lock hole 18 and the locking member from the locking engagement.

More specifically, as shown in FIG. 6, the operating member 34 comprises a leaf spring elongate in the right-left direction. The operating member 34 is generally formed into a crank shape and is bent frontward at a distal end side (right side as viewed in FIG. 6) and further rightward. The operating member 34 has a proximal end side (the left side) divided by two grooves into three divided parts. The upper and lower parts of the operating member 34 have left ends screwed to the front of the rotating disc 25. The central divided part of the operating member 24 is bent rearward thereby to be formed into a lock portion 35 serving as a lock member. This part of the operating member 34 protrudes to the rear surface side through an opening 25*b* formed in the rotating disc 25.

The operating member 34 includes a middle portion (located on the right of the three-divided portion) extending rightward through the notch 26*a* (see FIG. 5) formed in the mounting portion 26 and an opening 33*a* (see FIG. 3) formed in a part of the grip 33 extending rightward. The cranked part of the operating member 34 is disposed near the rear surface of the grip 33, and a distal end of the cranked part serves as a release operating portion 36 serving as a release operating member. In this case, as shown by solid line in FIG. 3, in a normal state or when the release operating portion 36 of the operating member 34 is not subjected to an external force, the lock portion 35 is urged by the spring force of the operating member 34 so as to protrude rearward, whereby the lock portion 35 is engageable with one of the four lock holes 18. As a result, the rotating frame 13 can be locked selectively at one of the four 90-degree-apart positions on the base frame 12 with respect to the rotational direction.

On the other hand, as shown by imaginary line in FIG. 3, when the operator operates the release operating portion 36 so as to pull the portion 36 frontward against the spring force, the lock portion 35 is displaced frontward thereby to be released from the locking engagement with the lock hole 18. Accordingly, when the operator operates to release the lock portion 35 from the locked state, the lock portion 35 is temporarily dropped out of the lock hole 18, whereby the rotating frame 13 can be rotatively moved relative to the base frame 12. In an operation for lock release, the operator applies his/her right thumb to the front face of the grip 33 and other right fingers to the rear face of the release operating portion 36 to pull the grip 33, whereupon the operator can pinch both grip 33 and release operating portion 36 with his/her right hand.

The cap-frame setting frame 11 will work as follows. The cap-frame setting frame 11 is fixed to the predetermined work table T by the fixing mechanism 15 as shown in FIGS. 8 and 9 before the operator sets the cap C on the cap frame 1. In this state, the cap-frame setting frame 11 is in a normal state where the grips 32 and 33 of the rotating frame 13 are located at right and left portions of the base frame 12 respectively, that is, the lock portion 35 of the operating member 34 is engaged with the right lock hole 18 of the base plate 14 thereby to be locked.

Subsequently, the operator holds the knobs 8 of the cap frame 1 with his/her hands to fit the cap frame 1 onto the outer circumference of the mounting portion 26 of the rotating frame 13 from the front in the direction of arrow Yb, as shown in FIGS. 8 and 9. As a result, the cap frame body 2 is fitted with the outer circumference of the mounting portion 26 of the rotating frame 13 from the front. The cap frame body 2 abuts the flange 28, and the engagement rollers 29*b* of the engagement member 29 are engaged with the engagement holes 9 respectively, as shown in FIG. 10. The cap frame 1 is thus attached to the cap-frame setting frame 11. When the cap frame body 2 is fitted with the mounting portion 26, the operator uses the grips 32 and 33 as handholds on which the operator puts his/her fingers. Consequently, a force can easily be applied to the knobs 8 of the cap frame 1, and accordingly, the cap frame 1 can easily be attached and detached.

The operator then sets the cap C on the cap support 3 so as to cover the cap support with the cap C, while the pressing portion 4, the flange fixing member 7*a* and the like are opened. In the setting work, the cap C including the front visor Ca is aligned with the cap frame 1 and thereafter, the pressing member 4 and the flange fixing member 7*a* are closed. Furthermore, the clips 6 are fastened to the receiving frame 5 so that the rear part of the cap C is held while the fabric of the cap C is stretched tight.

When the rotating frame 13 is in the normal state, the cap frame 1 can be attached to the cap-frame setting frame 11 more easily and the cap C can be put onto the cap frame 1, aligned and pressed by the pressing member 4 more easily. More specifically, it is desirable that these works should be carried out at a rotational position where the flange 28 of the rotating frame 13 is directed upward, as shown in FIGS. 1A, 1B and 8 to 10. On the other hand, the clips 6 are fastened to the receiving frame 5 to hold the rear side of the cap C while the fabric of the cap C is stretched tight. The work is hard to carry out in the normal state of the rotating frame 13. In this case, the working efficiency can be improved when the rear side of the cap C is directed sideways or upward.

Figure 2A:
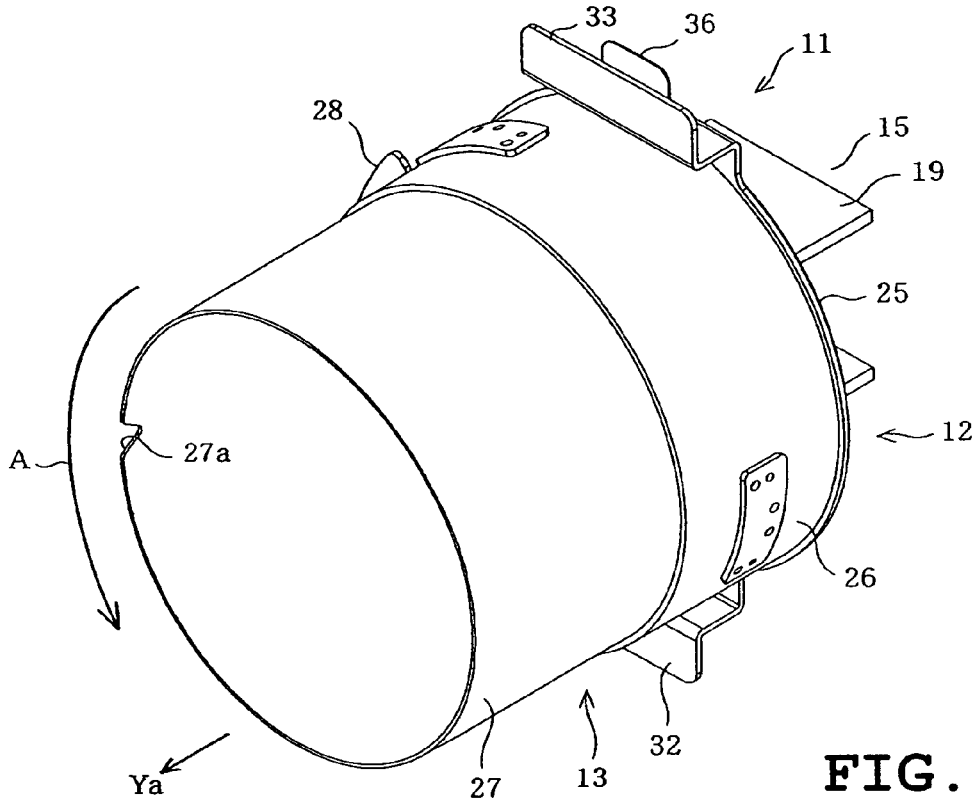
FIGS. 2A and 2B are perspective views of the embroidery-frame setting frame in the case where a rotating frame is rotated 90 degrees, as viewed from the front and the rear respectively.

In view of the above-mentioned situation, when the clips 6 are to be fastened to the receiving frame 5, for example, the rotating frame 13 of the cap frame 1 is turned 90 degrees in the direction of arrow A in FIG. 2A, that is, counterclockwise as viewed at the front. When the rotating frame 13 is rotated, the operator firstly holds the grips 32 and 33 with both hands respectively and pulls the release operating portion 36 of the operating member 34 frontward with his/her right hand. As a result, the lock portion 35 of operating member 34 is disengaged from the lock hole 18 of the base plate 14, thereby being released from the locked state and rendered rotatable.

When the operator holds the grips 32 and 33 to rotate the rotating frame 13 and the cap frame 1 and then detaches his/her fingers from the release operating portion 36 after rotation by about 90 degrees, the rotating frame 13 is positioned and locked on the base frame 12. Additionally, the rotating frame 13 may be rotated 180 degrees so as to be placed upside down or 90 degrees clockwise. In this case, the support member 16 constituting the base frame 12 is provided with the circular convex portion 16*a*. The rotating disc 25 constituting the rotating frame 13 has the fitting hole 25*a*. The fitting hole 25*a* of the rotating disc 25 is fitted with the outer circumference of the convex portion 16*a* so that the support member 16 is rotatably supported. Differing from the conventional supporting manner with a shaft, the above-described supporting manner of the embodiment employs the support member 16 having the circular convex portion 16*a* whose diameter can be increased sufficiently as compared with a shaft. As a result, the rotating frame 13 can be received by the outer circumferential portion of the circular convex portion 16*a*. Consequently, the load can be prevented from being concentrated on a part of the support which supports the rotating frame 13 of the base frame 12. Moreover, the rotating frame 13 can be rotated smoothly since it is received by the entire outer circumference of the convex portion 16*a*.

According to the above-described embodiment, the rotating frame 13 is rotatably supported on the base frame 12. In this construction, the rotating frame 13 can be received by the outer circumference of the circular convex portion 16*a* whose diameter can sufficiently be increased as compared with a shaft. As a result, the load concentration can be prevented in the supporting portion. This can realize a smooth rotative movement of the rotating frame 13.

Particularly in the embodiment, the circumferentially elongate grips 32 and 33 are mounted on the right and left opposed portions of the rotating disc 25 of the rotating frame 13. Accordingly, the operator can apply his/her hands to the respective grips 32 and 33 to rotate the rotating frame 13, whereupon the rotating work can be performed efficiently. Moreover, since the grips 32 and 33 are located so as to correspond to the knobs 8 respectively, the cap frame 1 can be attached to the cap-frame setting frame 11 more efficiently.

The rotating frame 13 and accordingly the cap frame 1 can be locked at a desired one of positions according to the working efficiency by the locking mechanism when rotated. In this case, the locking mechanism includes the lock holes 18 formed in the base plate 14 and the operating member 34 located on the right grip 33 of the rotating frame 13 (the rotating disc 25) and comprising the leaf spring. Accordingly, the operator is easy to operate the release operating portion 36. Furthermore, the lock mechanism can be realized by an exceedingly simple construction.

The foregoing embodiment should not be restrictive but may be expanded or changed as follows. For example, the base plate 14 of the base frame 12 may have three, five or more locked portions formed therein. As a result, a select pattern of lock positions with respect to the rotational direction of the rotating frame can be changed according to the number or locations of the locked portions. Furthermore, the locking mechanism may comprise a lock member and a release member both of which are discrete from each other. Although the protruding pieces 30 and 31 receiving the outer circumference of the support member 16 are formed on the rotating disc 25 in the foregoing embodiment, the protruding pieces 30 and 31 may be eliminated.

The holding cylindrical portion of the rotating frame may be formed into a semicylindrical shape without the lower half. Thus, the rotating frame may be changed in the shape, the structure and the like. For example, the cap frame should not be limited to the non-frame type but may be of the frame type in which a frame is provided which encloses an area of the cap on which embroidery is to be sewn. Additionally, attachment and detachment of the cap frame and the rotating frame may be realized by various structures.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A cap-frame setting frame to which a cap frame holding a cap with a part on which embroidery is to be sewn by an embroidery sewing machine is detachably attached, the cap-frame setting frame comprising:

a base frame having a distal end and a proximal end and including a fixing mechanism which is located at the proximal end side and is to be fixed to a predetermined work table;

a rotating frame provided at the distal end side of the base frame and having a cylindrical mount portion to which the cap frame is mounted so as to be positioned;

a disc-shaped support secured to the base frame to rotatably support the rotating frame; and a fitting portion provided on the base frame and configured to be fitted with an outer periphery of the disc-shaped support, thereby being rotatably supported on the base frame.

2. The cap-frame setting frame according to claim 1, wherein the rotating frame is provided with a grip protruding radially.

3. The cap-frame setting frame according to claim 2, wherein the cap frame is provided with a knob that is configured to be held by a user's hand, and the grip of the rotating frame is located so as to correspond to the knob of the cap frame.

4. The cap-frame setting frame according to claim 1, further comprising a locking mechanism which is configured to lock the rotating frame on the base frame selectively at one of a plurality of positions with respect to a rotational direction.

5. The cap-frame setting frame according to claim 2, further comprising a locking mechanism which is configured to lock the rotating frame on the base frame selectively at one of a plurality of positions with respect to a rotational direction.

6. The cap-frame setting frame according to claim 3, further comprising a locking mechanism which is configured to lock the rotating frame on the base frame selectively at one of a plurality of positions with respect to a rotational direction.

7. The cap-frame setting frame according to claim 4, wherein the locking mechanism includes a plurality of locked portions provided at the positions of the base frame respectively, a locking member which is provided on the rotating frame so as to be brought into locking engagement with one of the lock portions, and a release operating member which is operated to release the locking member and the locked portion from the locking engagement.

8. The cap-frame setting frame according to claim 5, wherein the locking mechanism includes a plurality of lock portions provided at the positions of the base frame respectively, a locking member which is provided on the rotating frame so as to be brought into locking engagement with one of the locked portions, and a release operating member which is operated to release the locking member and the locked portion from the locking engagement.

9. The cap-frame setting frame according to claim 6, wherein the locking mechanism includes a plurality of lock portions provided at the positions of the base frame respectively, a locking member which is provided on the rotating frame so as to be brought into locking engagement with one of the lock portions, and a release operating member which is operated to release the locking member and the locked portion from the locking engagement.

10. The cap-frame setting frame according to claim 7, wherein the rotating frame is provided with a grip protruding radially, and the release operating member is located near the grip of the rotating frame.

11. The cap-frame setting frame according to claim 8, wherein the rotating frame is provided with a grip protruding radially, and the release operating member is located near the grip of the rotating frame.

12. The cap-frame setting frame according to claim 9, wherein the rotating frame is provided with a grip protruding radially, and the release operating member is located near the grip of the rotating frame.

13. The cap-frame setting frame according to claim 7, wherein the locking member and the release operating member are formed from a material with springiness integrally with each other.

14. The cap-frame setting frame according to claim 8, wherein the locking member and the release operating member are formed from a material with springiness integrally with each other.

15. The cap-frame setting frame according to claim 9, wherein the locking member and the release operating member are formed from a material with springiness integrally with each other.

16. The cap-frame setting frame according to claim 10, wherein the locking member and the release operating member are formed from a material with springiness integrally with each other.

17. The cap-frame setting frame according to claim 11, wherein the locking member and the release operating member are formed from a material with springiness integrally with each other.

18. The cap-frame setting frame according to claim 12, wherein the locking member and the release operating member are formed from a material with springiness integrally with each other.

* * * * *